US007062865B1

(12) United States Patent
Nordt, III

(10) Patent No.: US 7,062,865 B1
(45) Date of Patent: Jun. 20, 2006

(54) ORTHOTIC

(76) Inventor: William E. Nordt, III, 7601 Forest Ave., Ste. 228, Richmond, VA (US) 23229

( * ) Notice: Subject to any disclaimer, the term of this patent is extended or adjusted under 35 U.S.C. 154(b) by 53 days.

(21) Appl. No.: 10/034,401

(22) Filed: Dec. 28, 2001

(51) Int. Cl.
*A43B 13/28* (2006.01)

(52) U.S. Cl. ..... 36/27; 36/43; 36/174; 36/179

(58) Field of Classification Search ..... 36/43, 36/27, 174, 179, 7.8, 151, 168, 176, 177, 36/180
See application file for complete search history.

(56) References Cited

U.S. PATENT DOCUMENTS 337,146 A * 3/1886 Gluecksmann ..... 36/7.8
881,974 A * 3/1908 Toporczer ..... 36/179
1,163,524 A * 12/1915 Gardiner ..... 36/151
1,255,794 A * 2/1918 Santella ..... 36/168
1,496,994 A * 6/1924 Mirizio ..... 36/168
2,129,424 A * 9/1938 Jay ..... 36/76 R
2,370,275 A * 2/1945 Ward ..... 36/182
3,999,558 A * 12/1976 Barnwell et al. ..... 36/145
5,311,680 A * 5/1994 Comparetto ..... 36/154
5,701,686 A * 12/1997 Herr et al. ..... 36/27

* cited by examiner

*Primary Examiner*—Ted Kavanaugh

(57) ABSTRACT

An orthotic device comprising a generally foot shaped body including depressable relief segments that underlie the metatarsal-phalangeal aspect of the foot and, optionally, the heel of the foot. The relief segments are provided by relieved areas cut or otherwise provided in the indicated areas of the orthotic device in such a way as to interdigitate within the device to define resilient segments that are depressed by the application of the weight of a user thereto and return to their original configuration upon removal of some or all that weight.

18 Claims, 4 Drawing Sheets

ORTHOTIC

FIELD OF THE INVENTION

The present invention relates to orthotic inserts or insoles for, for example, running or other athletic shoes, and more particularly to such devices that provide protective cushioning in the heel and metatarsal-phalangeal areas of the foot, while enhancing the athletes performance by providing lift or propulsion as the foot is lifted from an athletic surface during athletic activity.

BACKGROUND OF THE INVENTION

The design, construction and sale of athletic and other footwear that demonstrates improved comfort has attained very significant commercial proportions. Consequently, a great deal of effort has been expended to provide a more comfortable shoe particularly for runners and other athletes whose feet undergo extreme pressure during athletic activities. Thus, a very large number of insert and/or insole structures have been proposed to provide such added comfort and foot protection, particularly in the metatarsal-phalangeal and heel areas of the foot.

Among the proposed improvements is that disclosed in U.S. Pat. No. 5,542,196 to Kantro issued Aug. 6, 1996 that describes a innersole of two different materials one harder than the other, with the softer material located under the Ball and heel portion of the foot. While such a device provides one solution to the enhanced comfort problem, the device is multi-layered and fairly difficult to fabricate and therefore reasonably costly to produce. Additionally, it relies for its benefit on a difference in material properties, one harder than the other and therefore raises the potential that the softer material will deteriorate more quickly than the harder material.

It is well recognized by those familiar with the biomechanics of the human foot and ankle that in walking and running the foot passes through a cycle comprised of a number of phases often referred to as the gait cycle. One method of defining some of the portions of these phases as they relate specifically to the foot, is that the foot is "pronated" or more simply, relaxed, during that phase of the gait cycle when it about to and actually strikes the ground and assumes the foot-flat position, while it is defined as "supinated" or, more simply stiffened as it prepares to leave the ground for the toe-off position or the start of the next cycle. The reasons for this are fairly simple, intuitive and well understood. The foot is pronated as it strikes the ground so that it can adapt and adjust to the surface with which it is becoming engaged. The foot is supinated as it leaves the ground in the toe-off position so as to provide a levered platform to generate the drive or lift necessary to propel or launch the body forward toward the next step.

As evidenced by the large number of "new and improved" athletic shoes introduced each year that propose to improve running, jumping or other athletic performance, there have been numerous prior art methods proposed for enhancing athletic shoes to take advantage of the above-described foot positions and conditions to enhance athletic performance.

For example, U.S. Pat. No. 4,858,338 to Schmid, issued Aug. 22, 1989 describes a shoe sole insert made of an elastic material that purports to absorb and store energy as it is bent at the heel strike and midstance portions of the gait cycle and returns that energy to the wearer during and immediately following the toe off portion of the gait cycle.

U.S. Pat. No. 4,222,182 to Sears, issued Sep. 16, 1980 suggests the incorporation of a transverse spring steel member to accomplish absorption and regeneration of the energy acquired during the heel strike and midstance portions of the gait cycle.

U.S. Pat. No. 5,191,727 issued Mar. 9, 1993 to Barry et al. describes a propulsion plate for incorporation into footwear that includes a specially configured spring plate that extends beneath the medial but not the lateral portion of the heel, through the arch region, to and beneath the metatarsal head region and toe region to reduce the force spike at heel impact.

U.S. Pat. No. 5,052,130 to Barry et al., issued Oct. 1, 1991 describes an athletic shoe spring plate in combination with a viscoelastic midsole, the spring plate being fabricated of multiple layers of carbon fiber/polymer composite and having upturned heel and toe extremities.

While these and other similar proposed improvements have advanced the state of the art in foot comfort and performance for athletes, there remains a need for further improvements in foot comfort particularly for athletes as they continue to push their capabilities toward ever higher objectives, i.e. longer distances, higher jumps etc. and none of these prior art references alone or in combination suggests the unique structure described in this application that provides both comfort and the capture and return of energy generated naturally during the gait cycle.

OBJECTS OF THE INVENTION

It is therefore an object of the present invention to provide a more comfortable shoe insert or insole, particularly for athletic footwear.

It is another object of the present invention to provide such more a comfortable shoe insert or insole without relying solely on the presence of resilient or softer materials that tend to experience shorter useful lives than the harder materials more conventionally used in such orthotic devices because they provide foot protection and support.

It is yet another object of the present invention to provide an orthotic device that provides both added comfort and additional propulsive energy to the foot in the supinated, toe-off position and immediately thereafter.

It is therefore an object of the present invention to provide a semi-rigid kinetic energy storage device to enhance locomotion with relief areas that confer additional effects including the provision of: 1) foot comfort across the metatarsal-phalangeal joints (MTP), or ball of the foot, via its depressable nature while having the necessary rigidity to provide sufficient upward pressure as to maintain the overall energy storage capacity of the device through the provision of a series of one or more prongs arranged in any of a variety of directions, including forward pointing, sideward pointing, rearward pointing, downward pointing or upward pointing; and 2) a downward ground reaction force that resists bending and provides a spring-like effect that softens landing upon weight bearing and further provides a push-off spring effect for propulsion at the time of foot off.

SUMMARY OF THE INVENTION

These and other objects of the present invention are provided by an orthotic device comprising a generally foot shaped body that includes relieved areas that are separate from the main body of the device in areas that underlie the metatarsal-phalangeal aspect of the foot and optionally, the heel of the foot. These relieved areas interdigitate or disconnect to varying degrees from the main body of the device, and are cut, attached or otherwise provided in the indicated areas of the orthotic device to define resilient segments which are depressed by the application of the weight of a user and return to their original configuration upon removal of some or all that weight, as is accomplished in the normal gait cycle.

DETAILED DESCRIPTION

The present invention provides an orthotic device comprising a generally foot shaped body including interdigitated portions that underlie the metatarsal-phalangeal aspect of the foot, and optionally the heel of the foot. These interdigitated portions are provided by relieved areas having prongs or fingers cut or otherwise provided in the indicated areas of the orthotic device. The fingers or prongs are depressed upon the application of the user's weight and resiliently rebound to their original configuration upon removal of all or a portion of that weight. It is a characteristic of the interdigitated areas that they impart both a cushioning effect upon the application of pressure and a propulsive effect upon the removal of pressure as the foot enters and immediately as it leaves the toe off portion of the gait cycle.

Figure 1:
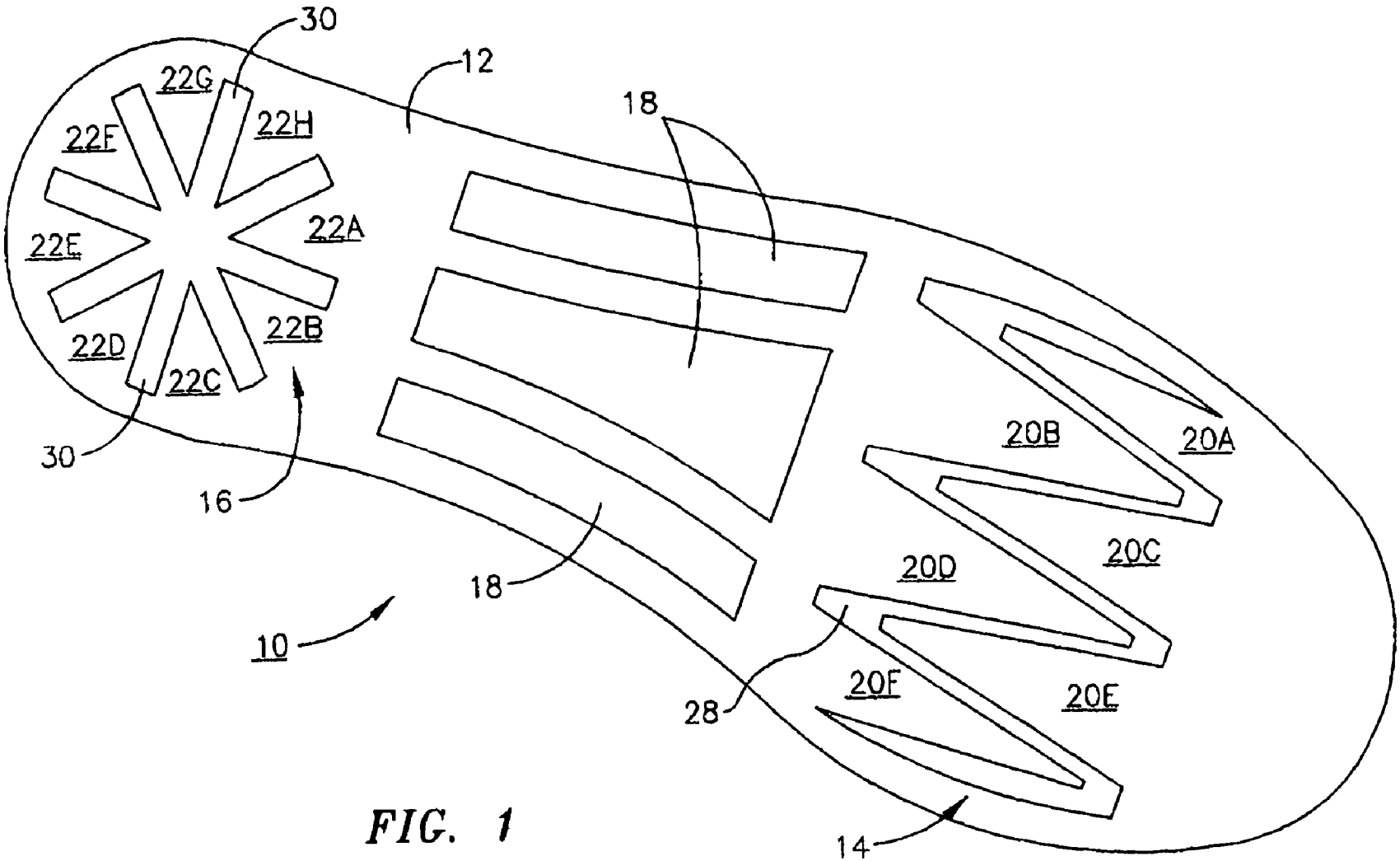
FIG. 1 is a bottom plan view of the orthotic device of the present invention.

Referring now to FIG. 1, orthotic 10 of the present invention comprises generally foot sole shaped base 12 having interdigitated areas 14, in the area of the ball of the foot or the forward area of base 12, i.e. the metatarsal-phalangeal aspect, and 16 in the area of the heel of base 12. Optionally, reliefs or cut-outs 18 may be provided in the area of the arch to lighten orthotic 10 and provide additional foot ventilation, or conversely, reinforced to affect the stiffness of the orthotic.

Area 14 underlies the metatarsal-phalangeal aspect of the foot, while area 16 is located to underlie the heel of the foot. As the weight bearing foot moves from the foot-flat to toe-off portion of the gait cycle, area 14 yields through depression of the interdigitated prongs or fingers 20A through 20F, energy is stored by depression or compression of prongs 20A through 20F and released and imparted to the foot of the user as the foot enters the toe off position. Prongs or interdigitated fingers 22A through 22F in area 16 serve to cushion and relieve contact pressure and store energy during the heel strike portion of the gait cycle, while releasing this stored energy in the form of proplulsive energy as the foot enters the later aspects of the gait cycle.

Figure 2:
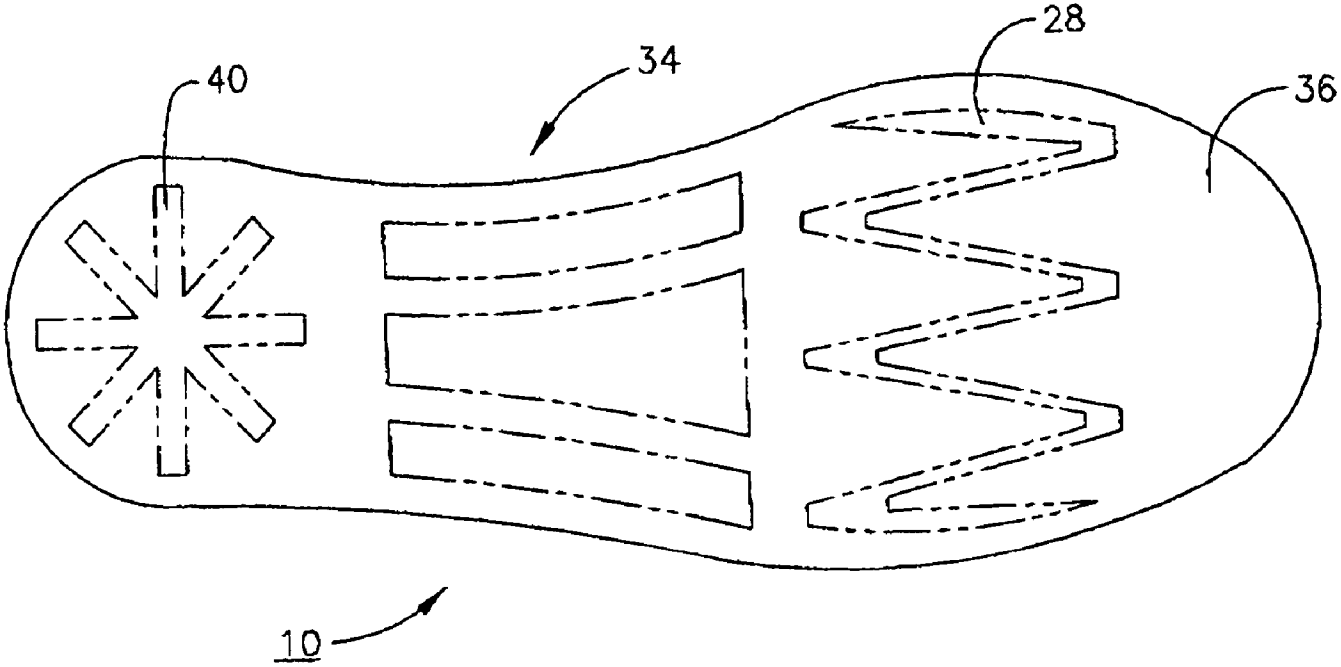
FIG. 2 is a partially phantom top plan view of the orthotic device of the present invention.

As best seen in FIG. 1 and also FIG. 2 that shows a cross-section of orthotic device 10 incorporated into the sole 24 an athletic shoe, interdigitated areas 14 and 16 are comprised of relieved areas 28 and 30 in the bottom of orthotic device 10 whose shapes, in this embodiment, define the shape of prongs or fingers 20A through 20F and 22A through 22F. Any number and shape of prongs can be substituted that achieves the desired end of depressability and spring-like resistance to the structure. In the case where orthotic device 10 is supplied as a separate insert rather than as part of the shoe, relieved areas 28 and 30 are cut or otherwise formed in the bottom of orthotic device 10. Generally, the larger the cut out area 28, the more relief and less resistance the device will impart.

Figure 6:
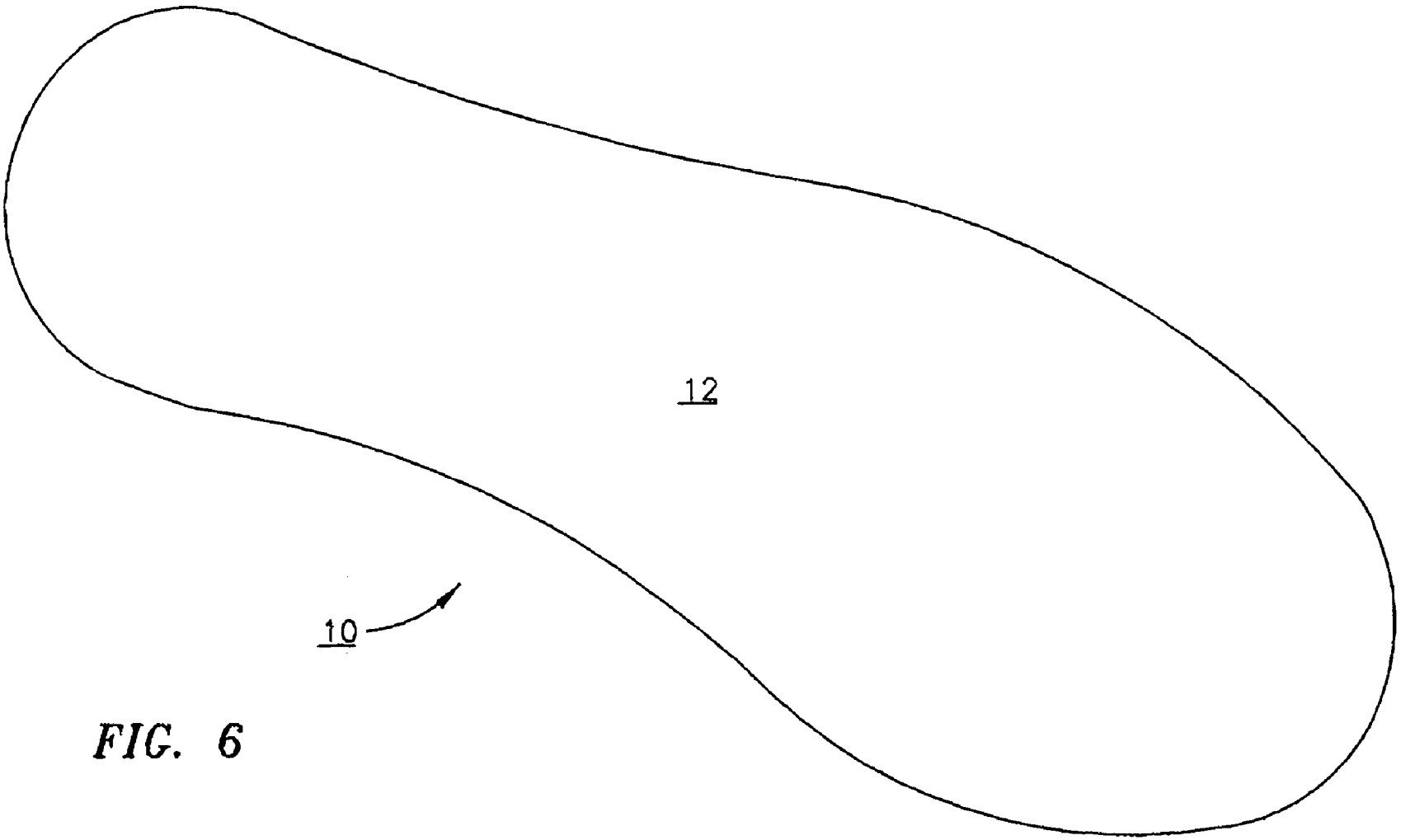
FIG. 6 is a top plan view of another alternative embodiment of the orthotic device of the present invention having the pattern shown in FIG. 1 cut or otherwise formed in the bottom surface thereof.

Thickness 32 may vary from less than a millimeter to several centimeters or more. Thickness 32 is limited only by the comfort of the wearer and/or the thickness of the shoe sole depending upon the weight of the user and the design of areas 14 and 16. Of course, areas 14 and 16 can be relieved to differing levels in the same orthotic device 10, if desired. The thickness 32 of orthotic 10 need not be consistent. The thickness and/or material natures of areas 14 and 16 may vary from that of the overall orthotic 10 As an insert, orthotic device 10 may include a separate padded or resilient surface (not shown) on top surface 36 as is conventional practice in the design of orthotic devices of similar types. In such a case the separate resilient surface would be considered an integral part of orthotic device 10 for purposes of calculating the degree of acceptable relief. Such an embodiment is shown when upper surface 12 depicted in FIG. 6 is viewed in concert with lower surface 12A depiocted in FIG. 1.

It should be noted that the configuration of interdigitated areas 14 and 16 can be varied widely from that shown in the attached figures. For example, prongs or fingers 20A through 20F could be oriented transversely to the length of the shoe rather than longitudinally as shown in the attached figures. Similarly, prongs or fingers 22A through 22H could define an overall oval, generally rectangular or any other suitable shape so long as appropriate energy absorption, storage and release is obtained from the configuration chosen and foot comfort is not sacrificed. Similarly, a larger or smaller number of fingers or prongs can be included by the simple expedient of changing the shape of relieved areas 28 and 30. Additionally, the prongs need not have symetrical interdigitations, for instance, shortening of one of the two opposing sets of prongs would provide a lesser degree of the desired effect.

Figure 3:
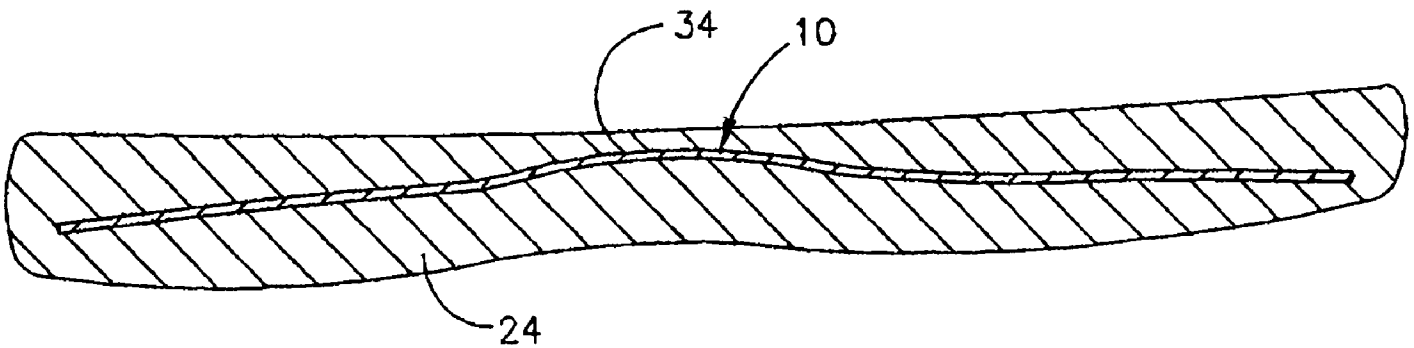
FIG. 3 is a schematic cross-sectional representation of an athletic shoe incorporating the orthotic device of the present invention.
Figure 4:
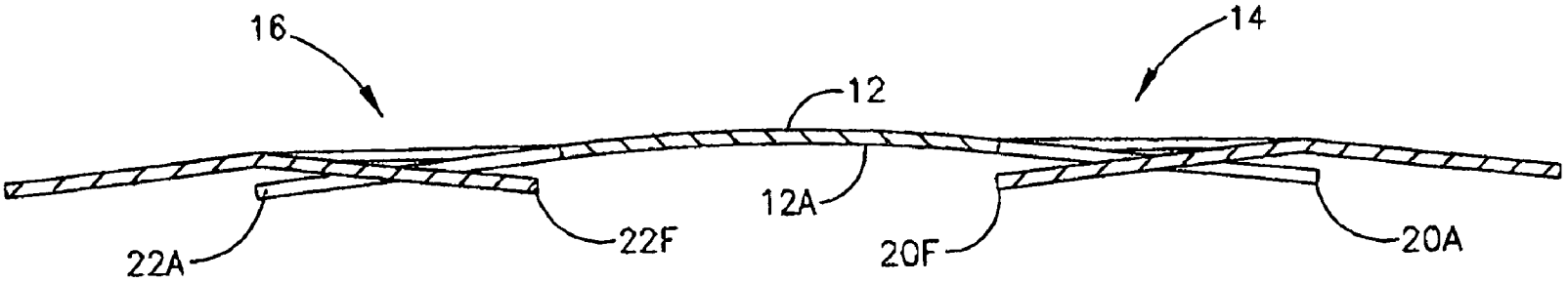
FIG. 4 is a cross-sectional view of an alternative preferred embodiment of the orthotic device of the present invention.
Figure 5:
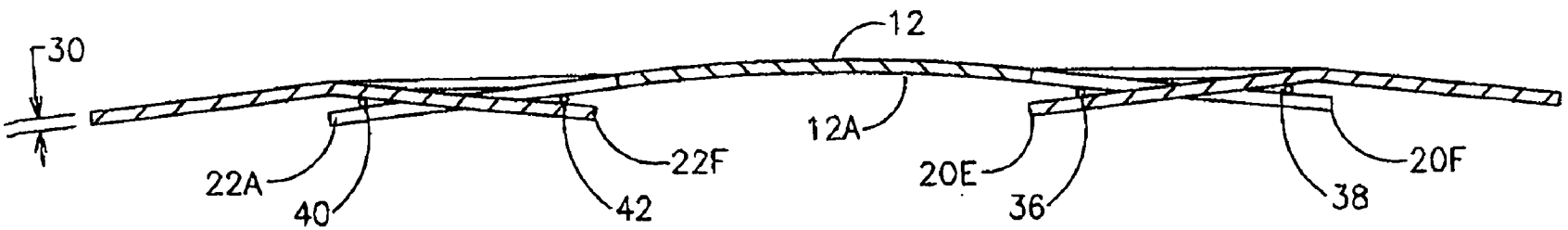
FIG. 5 is a cross-sectional view of yet another alternative preferred embodiment of the orthotic device of the present invention.

Although orthotic device 10 may comprise a substantially flat member as depicted in FIGS. 1 and 2, this and all described alternative embodiments thereof, may also incorporate an arch 34 at the appropriate location therein to provide the generally desirable arch support as shown in FIG. 3, as well as other curves or structural reinforcements. Orthotic device 10 can be supplied in varying arch widths and depths when provided as an insole or insert and can be incorporated into the sole of the shoe when provided as an integral part thereof. Any and all such modifications are clearly intended to be within the scope of the appended claims. Additionally, areas 14 and 16 may be flat, i.e. follow the contour of device 10 as depicted in FIG. 3, or may be curved or levered downward or upward to enhance the fundamental effect of prong compression as shown in FIGS. 4 and 5. Such a configuration is consistent with both the comfort and propulsive objectives of the device of the present invention.

Additionally, areas 14 and 16 mat be flat, i.e. follow the contour of device 10 as depicted in FIG. 3, or may be curved or levered downward or upward to enhance the fundamental effect of prong compression. Such a configuration is consistent with both the comfort and propulsive objectives of device 10.

Referring now to FIG. 4, while in the description of previous embodiments in connection with FIGS. 1–3 orthotic device 10 has been shown as incorporating essentially flat interdigitated prongs or fingers, according to the preferred embodiment depicted in FIG. 4, interdigitated prongs or fingers 20A–20F and 22A–22F are formed bent or slanted downward such that they project below lower surface 12A of orthotic device 10. With this configuration, interdigitized prongs or fingers 20A–20F and 22A–22F provide additional resistance to downward pressure thereon and thus store more energy as the foot compresses them and release this increase energy as the foot moves to release the pressure thereon.

This enhanced energy storage and release can be further enhanced with the structure depicted in FIG. 5 wherein fulcrums 40 and 42 and 36 and 38 have been introduced between interdigitated prongs or fingers 20A–20F and 22A–22F and lower surface 12A of orthotic device 10. The introduction of fulcrums 40, 42, 36 and 38 further increase the resistance of interdigitated fingers or prongs 20A–20F and 22A–22F to deflection as the foot moves downward resulting in an increase the amount of energy stored by this action and allowing the release of this additional energy as the foot rises toward the next step. Fulcrums 40, 42, 36 and 38 may comprise simply a thickening of the material of orthotic device 10 at the appropriate points or the introduction of a fine metal or other material rod at this point to provide the appropriate fulcrum. The location of fulcrums 40, 42, 36 and 38 may be varied depending upon the degree of enhanced resistance sought to be provided. Thus, the fulcrums may be located immediately proximate surface 12A or located outward along the lengths of prongs 20A–20F and 22A–22F. As the fulcrum is moved outward along the length of the prongs, the resistance to bending demonstrated by the prongs will increase. Whatever mechanism is used, caution must me exercised not to compromise the comfort of orthotic 10 by the introduction of fulcrums as described and shown.

The materials of construction of orthotic device 10 are similarly also largely a matter of design choice subject to certain inherent and fundamental requirements. The material(s) of construction should be one(s) that demonstrate strong tendencies to retain their original shape and when deflected or deformed tend to return to that original shape. Such materials will inherently resist bending moments and incorporate significant spring-like capabilities that provide the energy storage and release properties necessary to achieve the advantageous performance desired when deflected by the weight of the wearer. High tensile strength materials having moduli of elasticity above about $32\times10^6$ $lb/in^2$ are suitable for this application. The material is also preferably lightweight so as not to add to the athletes lifting burden during strenuous activity. Suitable materials include carbon and graphitic materials of the types used in prior art orthotic devices including carbon—carbon, and polymer-matrix carbon composites and the like as well as spring steel and fiberglass materials demonstrating these properties. Graphite fiber materials possessing light weight, high tensile strength, high modulus of elasticity and that are generally easily fabricated are specifically preferred in such applications The selection of such materials is well within the skill of the art once the design and functioning characteristics of orthotic device 10 and know and understood. Specific material selection, orthotic device thickness 40 and the depth dimensions of relieved areas 28 and 30 can and ideally are custom matched to the wearer depending upon his or her foot size and body weight for optimum performance.

Orthotic device 10 is preferably, of course of a size to cover substantially the entire bottom of the wearer's foot so as to provide maximum efficiency in use.

As the invention has been described, it will be apparent to those skilled in the art that the same can be varied in many ways without departing from the spirit and scope of the invention. Any and all such modifications are intended to be included within the scope of the appended claims.

What is claimed is:

1. A orthotic device comprising a generally foot sole shaped base of a material the resists flexing and having a metatarsal-phalangeal area and a heel area and including an interdigitated prongs in the metatarsal-phalangeal area of the orthotic device that underlies the metatarsal-phalangeal aspect of the foot of the user.

2. The orthotic device of claim 1 further including an interdigitated prongs in the heel area that underlies the heel of a user.

3. The orthotic device of claim 2 wherein said orthotic has a thickness and an upper and a lower surface and said interdigitated prongs are formed by relieved areas formed in said lower surface to a depth adequate to allow depression or deviation of said interdigitated prongs from the main body of said device.

4. The orthotic device of claim 2 fabricated from a material selected from the group consisting of graphite, graphite fibers, carbon, carbon—carbon composites, polymer composites, fiberglass and spring steel.

5. The orthotic device of claim 1 having an upper and a lower surface and a thickness wherein said interdigitated prongs is defined by a relieved area formed in said lower surface and said relieved area defines one or more resilient prongs that flex to store energy when the weight of the user is applied thereto and flex to release said stored energy when said weight is removed from said prongs.

6. The orthotic device of claim 5 wherein said relieved area is formed in said lower surface to allow for depression or deviation from the main body of the device.

7. The orthotic device of claim 5 wherein said resilient prongs have a base end at the point of attachment to said base and a distal end and wherein said distal end projects below said base end thereby providing an enhanced energy storage capability.

8. The orthotic device of claim 7 further including a fulcrum at said base end to further increase the energy storage and release capability of said resilient prongs upon deformation and release.

9. The orthotic device of claim 1 fabricated from a material selected from the group consisting of graphite, graphite fibers, carbon, carbon—carbon composites, polymer composites, fiberglass and spring steel.

10. An orthotic device comprising a generally foot sole shaped base of a material that resists flexing and having a metatarsal-phalangeal area and a heel area and including interdigitated prongs comprising a generally radial array of inwardly extending prongs in the metatarsal-phalangeal area of the orthotic device that underlies the metatarsal-phalangeal aspect of the foot of a user.

11. The orthotic device of claim 10 further including interdigitated prongs portion comprising a generally radial array of inwardly extending prongs in the heel area that underlies the heel of a user.

12. The orthotic device of claim 11 wherein said orthotic has a thickness and an upper and a lower surface and said interdigitated prongs are formed by relieved areas formed in said lower surface to a depth adequate to allow depression or deviation of said interdigitated prongs from the main body of said device.

13. The orthotic device of claim 11 fabricated from a material selected from the group consisting of graphite, graphite fibers, carbon, carbon—carbon composites, polymer composites, fiberglass and spring steel.

14. The orthotic device of claim 10 having an upper and a lower surface and a thickness wherein said interdigitated prongs is defined by a relieved area formed in said lower surface and said relieved area defines one or more resilient prongs that flex to store energy when the weight of the user is applied thereto and flex to release said stored energy when said weight is removed from said prongs.

15. The orthotic device of claim 14 wherein said relieved area is formed in said lower surface to allow depression from the main body of said device.

16. The orthotic device of claim 14 wherein said resilient prongs have a base end at the point of attachment to said base and a distal end and wherein said distal end projects below said base end thereby providing an enhanced energy storage capability.

17. The orthotic device of claim 16 further including a fulcrum at said base end to further increase the energy storage and release capability of said resilient prongs upon deformation and release.

18. The orthotic device of claim 10 fabricated from a material selected from the group consisting of graphite, graphite fibers, carbon, carbon—carbon composites, polymer composites, fiberglass and spring steel.

* * * * *